US009509035B2

(12) United States Patent
Wang

(10) Patent No.: US 9,509,035 B2
(45) Date of Patent: Nov. 29, 2016

(54) INDOOR ANTENNA

(71) Applicant: TRANS ELECTRIC CO., LTD., Changhua Hsien (TW)

(72) Inventor: Cheng-Si Wang, Changhua Hsien (TW)

(73) Assignee: TRANS ELECTRIC CO., LTD., Changhua Hsien (TW)

( * ) Notice: Subject to any disclaimer, the term of this patent is extended or adjusted under 35 U.S.C. 154(b) by 37 days.

(21) Appl. No.: 14/542,952

(22) Filed: Nov. 17, 2014

(65) Prior Publication Data

US 2016/0141745 A1 May 19, 2016

(51) Int. Cl.
*H01Q 1/24* (2006.01)
*H01Q 1/00* (2006.01)

(52) U.S. Cl.
CPC ..... *H01Q 1/00* (2013.01)

(58) Field of Classification Search
CPC ..... H01Q 1/243; H01Q 1/38; H01Q 9/0421; H01Q 1/125
USPC ..... 343/702, 833, 834, 880
See application file for complete search history.

(56) References Cited

U.S. PATENT DOCUMENTS 7,046,211 B1 * 5/2006 Wang ..... H01Q 1/1207 343/880
2012/0293391 A1 * 11/2012 Simmons ..... H01Q 1/007 343/859

* cited by examiner

*Primary Examiner* — Dameon E Levi
*Assistant Examiner* — Collin Dawkins
(74) *Attorney, Agent, or Firm* — Lynette Wylle; Apex Juris, PLLC.

(57) ABSTRACT

An indoor antenna having a cover body with a panel cover, a coax cable panel, and a coax cable. The panel cover has an edge and at least one first coax cable channel formed in a side of the coax cable panel and is formed through the edge of the panel cover. The coax cable panel is mounted in the cover body. The coax cable is electrically connected with the coax cable panel, inserted through the panel cover, mounted in one of the at least one first coax cable channel, and extending out of the edge of the panel cover. Therefore, when the indoor antenna is assembled, the coax cable can be arranged firmly without over-bending, such that the indoor antenna sustains good performance and be assembled easily.

11 Claims, 8 Drawing Sheets

INDOOR ANTENNA

BACKGROUND OF THE INVENTION

1. Field of the Invention

The present invention relates to an antenna, and more particularly to an indoor antenna.

2. Description of Related Art

With reference to FIG. 8, a conventional indoor antenna 90 is provided for receiving digital signals and has a cover 91, a cable panel, a cable 92, a hanging hole 93, a pad 94, and a bracket 95. The cable panel is mounted in the cover 91. The cable 92 is electrically connected with the cable panel and extends out of the cover 91. The hanging hole 93 is formed in a rear side of the cover 91 for hanging the antenna 90 on a wall. The pad 94 is mounted on the rear side of the cover 91 for disposing the antenna 90 flattened on a ground. The bracket 95 is mounted on the rear side of the cover 91 for erecting the antenna 90 upright on the ground. Therefore, the indoor antenna can be assembled in different ways depending on different demands.

However, the conventional indoor antenna 90 has a structural limit. Arrangement of the cable 92 is difficult for a user though the indoor antenna 90 can be assembled in different ways. For example, for aesthetics demand and for reducing an installation space of the indoor antenna 90, the rear side of the cover 91 is arranged to abut the wall or ground. However, when the cover 91 abuts the wall or the ground, a portion of the cable 92 that protrudes out of the cover 91 may be bent, such that the digital signal transmitted by the cable 92 may be lost because of the bent cable 92. At the same time, the bent cable 92 may affect the assembling of the indoor antenna 90, such that the cover 91 cannot accurately abut the ground or the wall.

SUMMARY OF THE INVENTION

The main objective of the present invention is to provide an indoor antenna to resolve the afore-mentioned problems.

The indoor antenna has a cover body, a coax cable panel, and a coax cable.

The cover body has a panel cover. The panel cover has an edge and at least one first coax cable channel formed in a side of the panel cover and formed through the edge of the panel cover.

The coax cable panel is mounted in the cover body.

The coax cable is electrically connected with the coax cable panel, inserted through the panel cover, mounted in one of the at least one first coax cable channel, and extending out of the edge of the panel cover.

Other objectives, advantages and novel features of the present invention will become more apparent from the following detailed description when taken in conjunction with the accompanying drawings.

DETAILED DESCRIPTION OF PREFERRED EMBODIMENT

Figure 1:
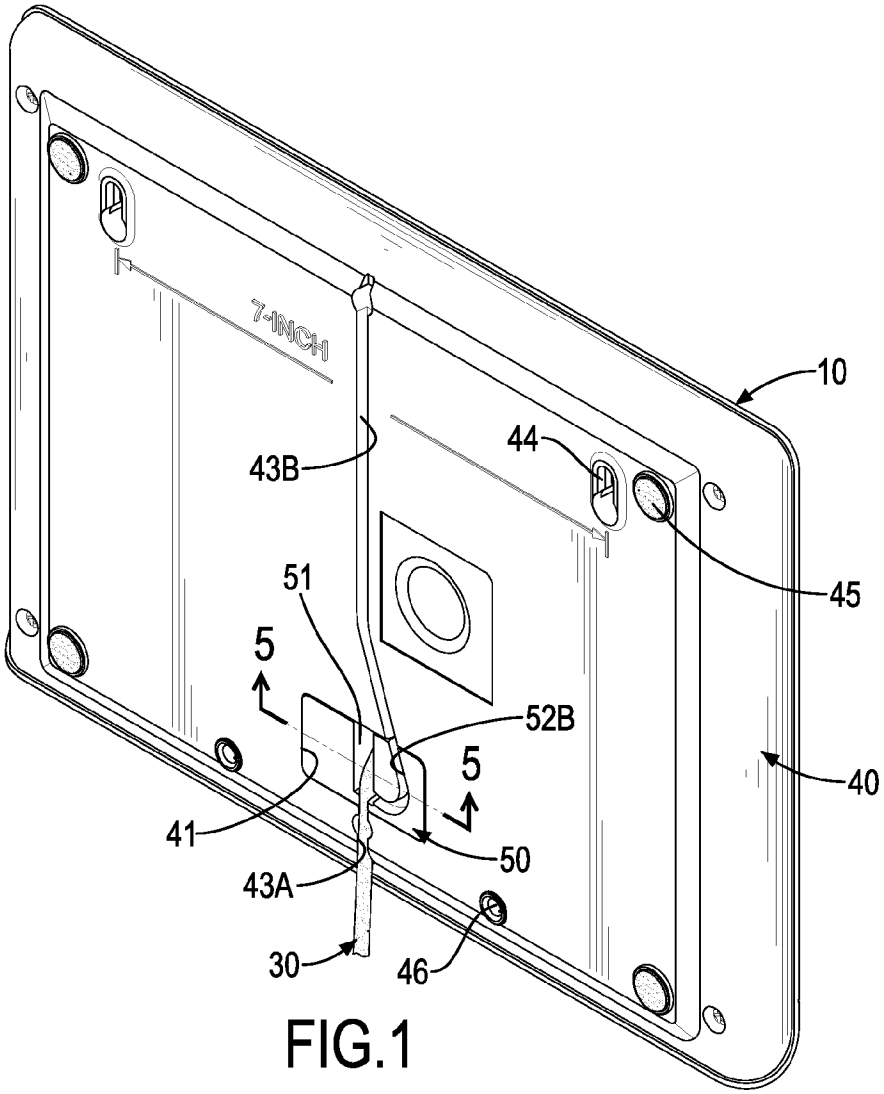
FIG. 1 is a perspective view of a preferred embodiment of an indoor antenna in accordance with the present invention.

With reference to FIGS. 1 to 5, a preferred embodiment of an indoor antenna in accordance with the present invention has a base panel 10, a coax cable panel 20, a coax cable 30, a panel cover 40, and a hole cover 50.

Figure 2:
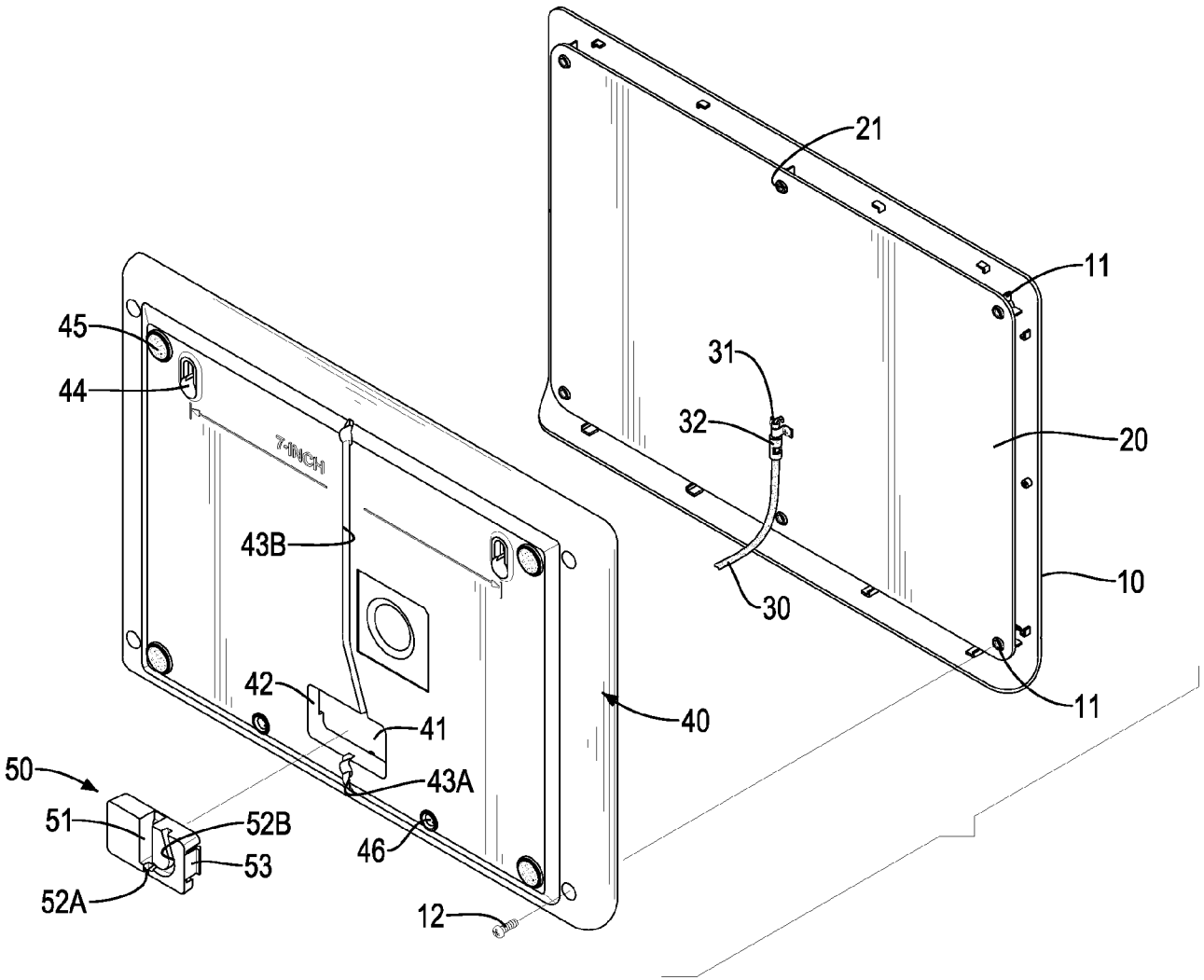
FIG. 2 is an exploded perspective view of the indoor antenna in FIG. 1.
Figure 3:
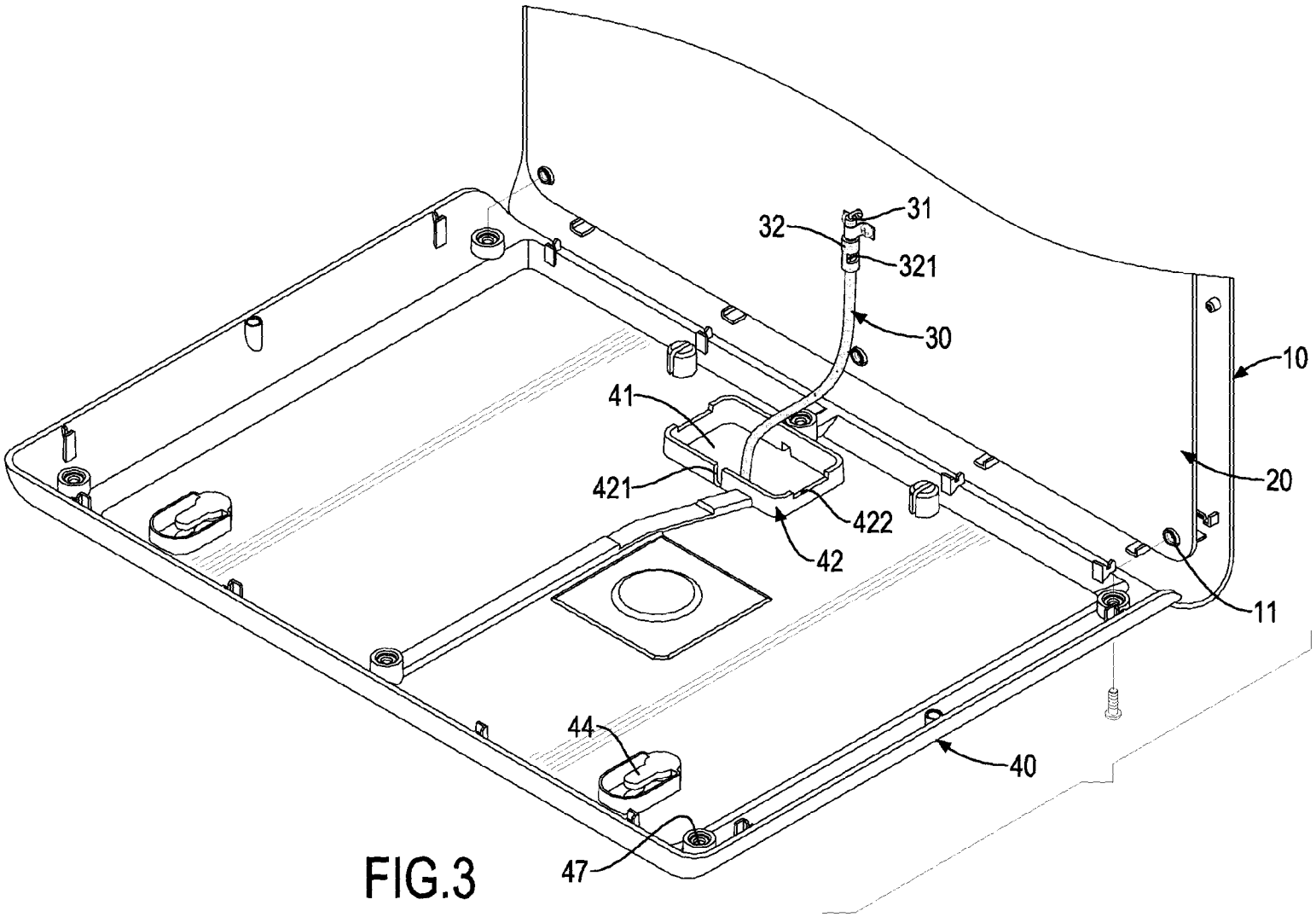
FIG. 3 is an enlarged exploded perspective view of the indoor antenna in FIG. 1.

With reference to FIGS. 2 and 3, the base panel 10 may be rectangular and is located at a front side of the indoor antenna. The base panel 10 has a rear side and multiple fixing columns 11 annularly arranged on the rear side of the base panel 10 at intervals.

The coax cable panel 20 may be rectangular and is combined with the base panel 10. The coax cable panel 20 has multiple positioning holes 21 formed through the coax cable panel 20 and respectively disposed around the fixing columns 11, such that the coax cable panel 20 can be combined with the rear side of the base panel 10.

Figure 4:
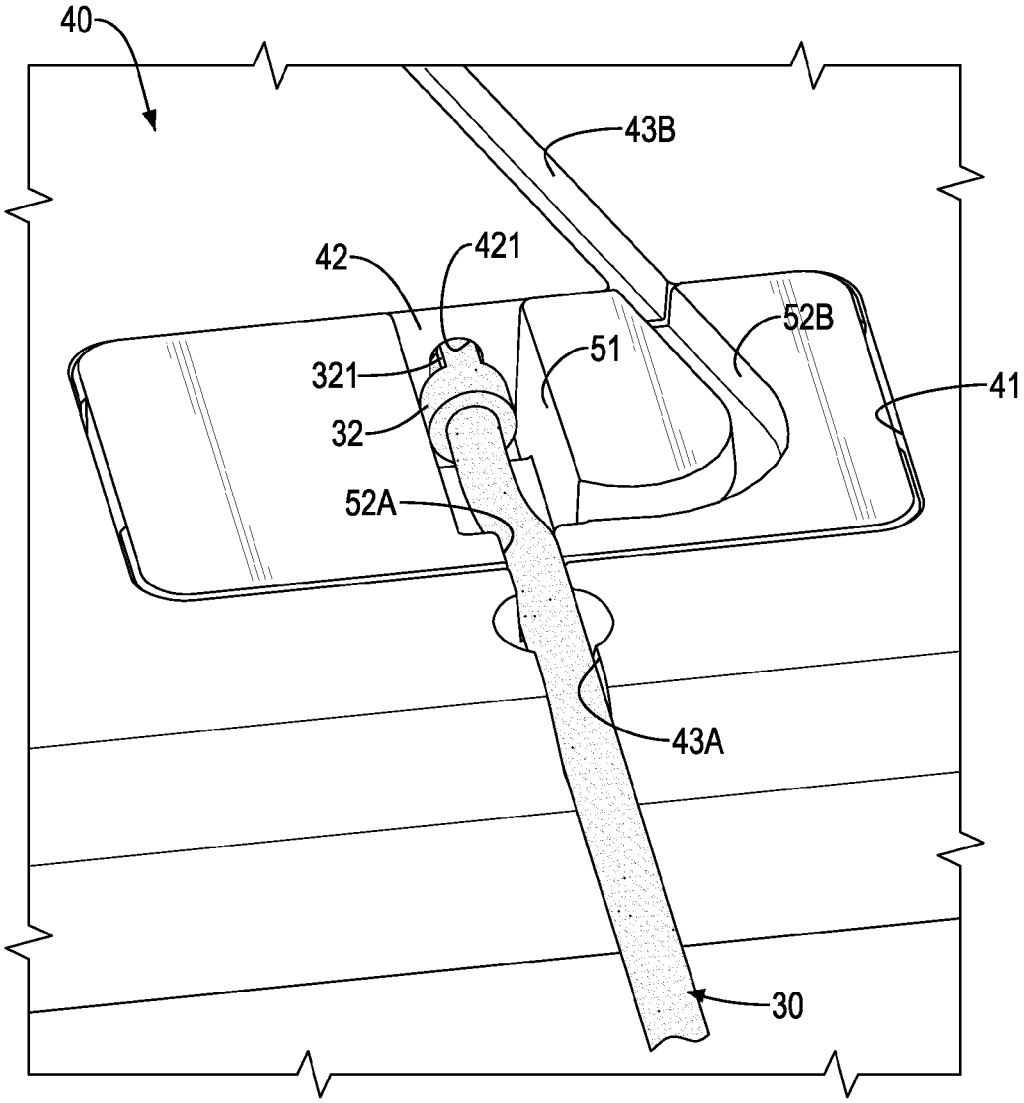
FIG. 4 is an enlarged perspective view of the indoor antenna in FIG. 1.

With reference to FIGS. 3 and 4, the coax cable 30 may be a coaxial coax cable and is welded on and electrically connected with the coax cable panel 20. The coax cable 30 has a connecting end 31 welded on and electrically connected with a desired position on the coax cable panel 20. A positioning sleeve 32 is mounted around the coax cable 30 and is adjacent to the connecting end 31. An outer diameter of the positioning sleeve 32 is larger than an outer diameter of the coax cable 30. The positioning sleeve 32 has two engagement recesses 321 respectively formed in two sides of the positioning sleeve 32. The coax cable 30 further has a connector end that can be connected with a television or a communication appliance.

With reference to FIGS. 2 to 4, the panel cover 40 may be rectangular, is combined with the base panel 10 and shelters the coax cable panel 20. The panel cover 40 and the base panel 10 are combined with each other to form a cover body of the indoor antenna. The panel cover 40 has multiple panel cover holes 47 formed in a first side of the panel cover 40 at intervals and respectively aligned with the fixing columns 11. Multiple bolts 12 are respectively inserted into the panel cover holes 47 and respectively combined with the fixing columns 11, such that the panel cover 40 can be fixed on the base panel 10 to form the cover body, and the coax cable panel 20 can be sheltered between the base panel 10 and the panel cover 40.

The panel cover 40 has an edge, a cover through hole 41, a hole wall 42, multiple first coax cable channels 43A, 43B, a pair of hanging holes 44, multiple pads 45, and a pair of bracket holes 46. The edge is formed annularly around the panel cover 40. The cover through hole 41 may be rectangular, is formed through the panel cover 40, and is adjacent to a bottom of the panel cover 40. The coax cable 30 is inserted through the panel cover 40 via the cover through hole 41. The hole wall 42 is formed on the first side of the panel cover 40 and annularly surrounds the cover through hole 41 and has a coax cable slit 421 and two engagement notches 422. The coax cable slit 421 is formed through the hole wall 42 and accommodates the coax cable 30. The engagement recesses 321 of the positioning sleeve 32 are clamped by the coax cable slit 421, such that when the panel cover 40 is combined with the base panel 10, a position of the coax cable 30 can be fixed. The engagement notches 422 are formed in the hole wall 42. The first coax cable channels 43A, 43B are elongated, are formed in a second side of the panel cover 40 and are formed through the edge of the panel cover 40, wherein a width of any one of the first coax cable channels 43A, 43B is not less than a diameter of the coax cable 30. The first coax cable channel 43A is formed through a top of the edge of the panel cover 40. The first coax cable channel 43B is formed through a bottom of the edge of the panel cover 40. The coax cable 30 is selectively mounted in and along one of the first coax cable channels 43A, 43B and extends out of the edge of the panel cover 40.

Alternatively, the panel cover 40 may have more than two first coax cable channels 43A, 43B, and extension directions of the first coax cable channels 43A, 43B are not limited in the present invention. The panel cover 40 may have eight first coax cable channels radially formed in the first side of the panel cover 40 to provide eight options for arranging the extension directions of the coax cable 30. Preferably, the panel cover 40 has two first coax cable channels 43A, 43B respectively extending toward a top and the bottom of the panel cover 40.

The pair of hanging holes 44 is formed in the second side of the panel cover 40. The pads 45 are mounted on the second side of the panel cover 40. The pair of bracket holes 46 is formed in the second side of the panel cover 40, wherein a bracket can be mounted in the pair of bracket holes 46. The pair of hanging holes 44, the pads 45 and the pair of bracket holes 46 can provide different assembling ways for the indoor antenna. The indoor antenna can be hung on a wall via the pair of the hanging holes 44, can be disposed flattened on a ground by the pads 45, or can be erected upright on the ground by the bracket mounted in the pair of the bracket holes 46.

The hole cover 50 may be rectangular, and is combined in the cover through hole 41, and further includes a coax cable recess 51, multiple second coax cable channels 52A, 52B, and a pair of engagement plates 53. The coax cable recess 51 is formed in a side of the hole cover 50, accommodates the coax cable 30, and is aligned with the coax cable slit 421. The second coax cable channels 52A, 52B are formed in the side of the hole cover 50, communicate with the coax cable recess 51, and respectively communicate with the first coax cable channels 43A, 43B. The coax cable 30 can be mounted in one of the first coax cable channels 43A, 43B and in the second coax cable channel 52A, 52B that communicates with the first coax cable channel 43A or 43B.

Preferably, the hole cover 50 has two second coax cable channels 52A, 52B respectively communicating with the first coax cable channels 43A, 43B. Alternatively, the second coax cable channels 52A, 52B may be omitted, and the coax cable recess 51 directly communicates with the first coax cable channels 43A, 43B.

Figure 5:
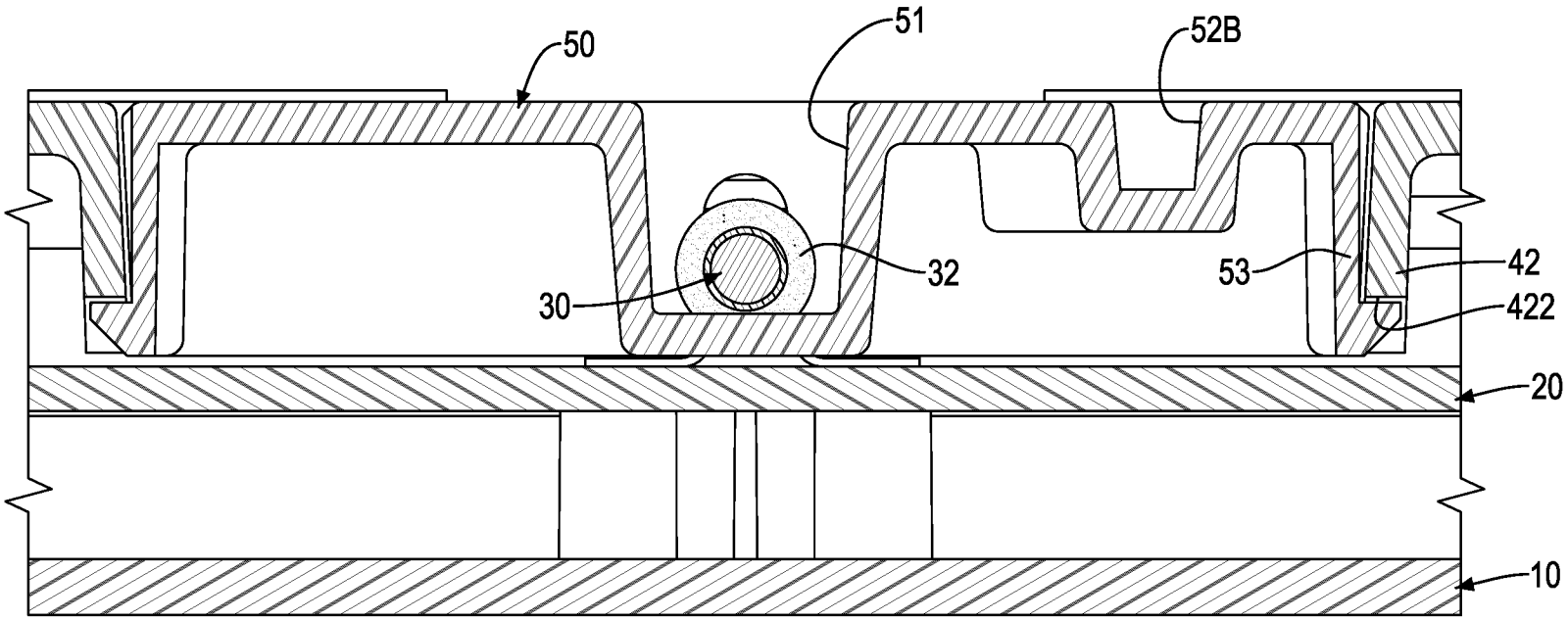
FIG. 5 is an enlarged cross sectional side view of the indoor antenna in FIG. 1.

Further with reference to FIG. 5, the pair of engagement plates 53 is elastic, is formed on the hole cover 50, and is detachably engaged with the pair of engagement notches 422, such that the hole cover 50 can be detachably mounted in the cover through hole 41.

Figure 6:
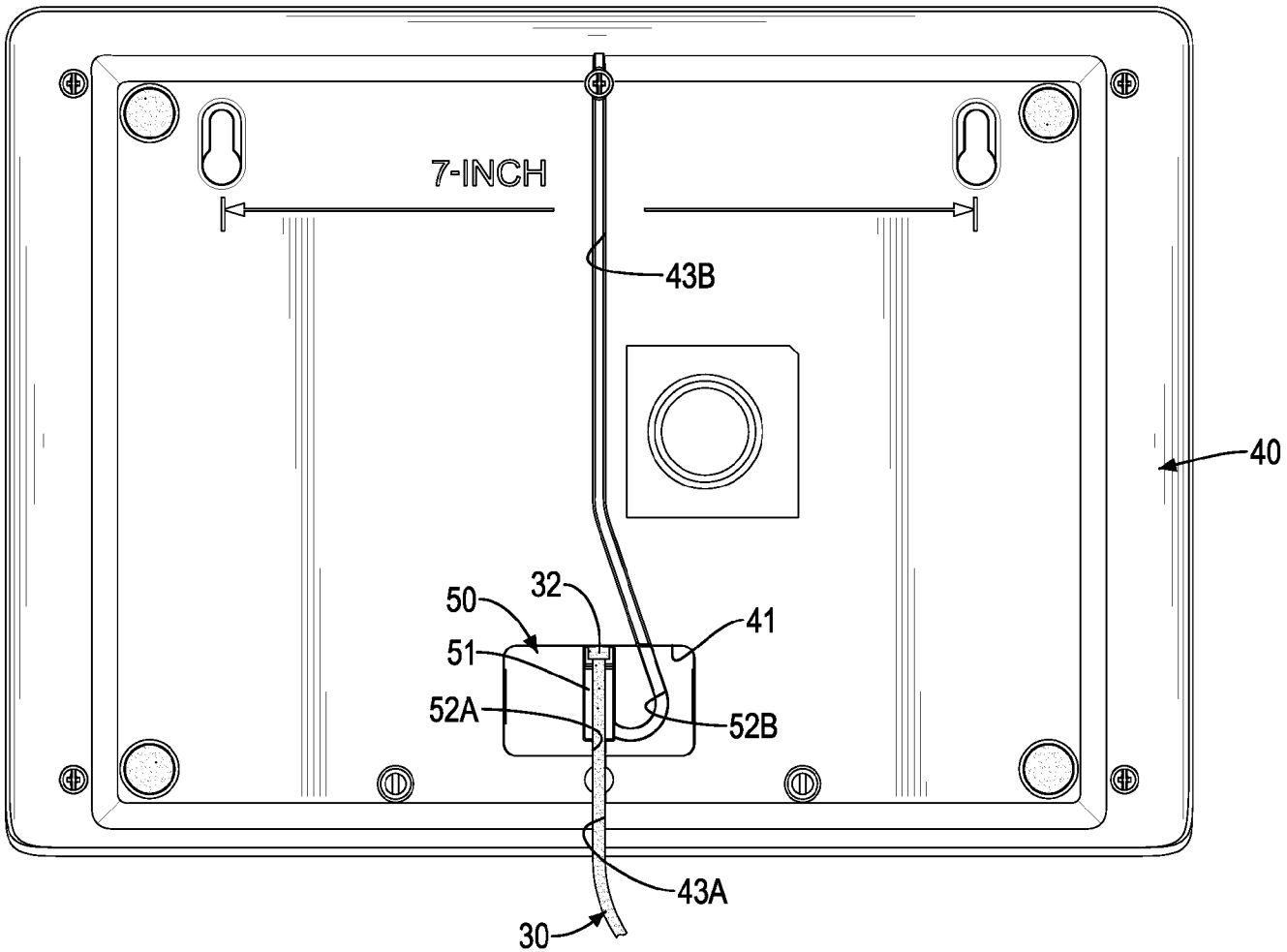
FIG. 6 is an operational rear view of the indoor antenna in FIG. 1.
Figure 7:
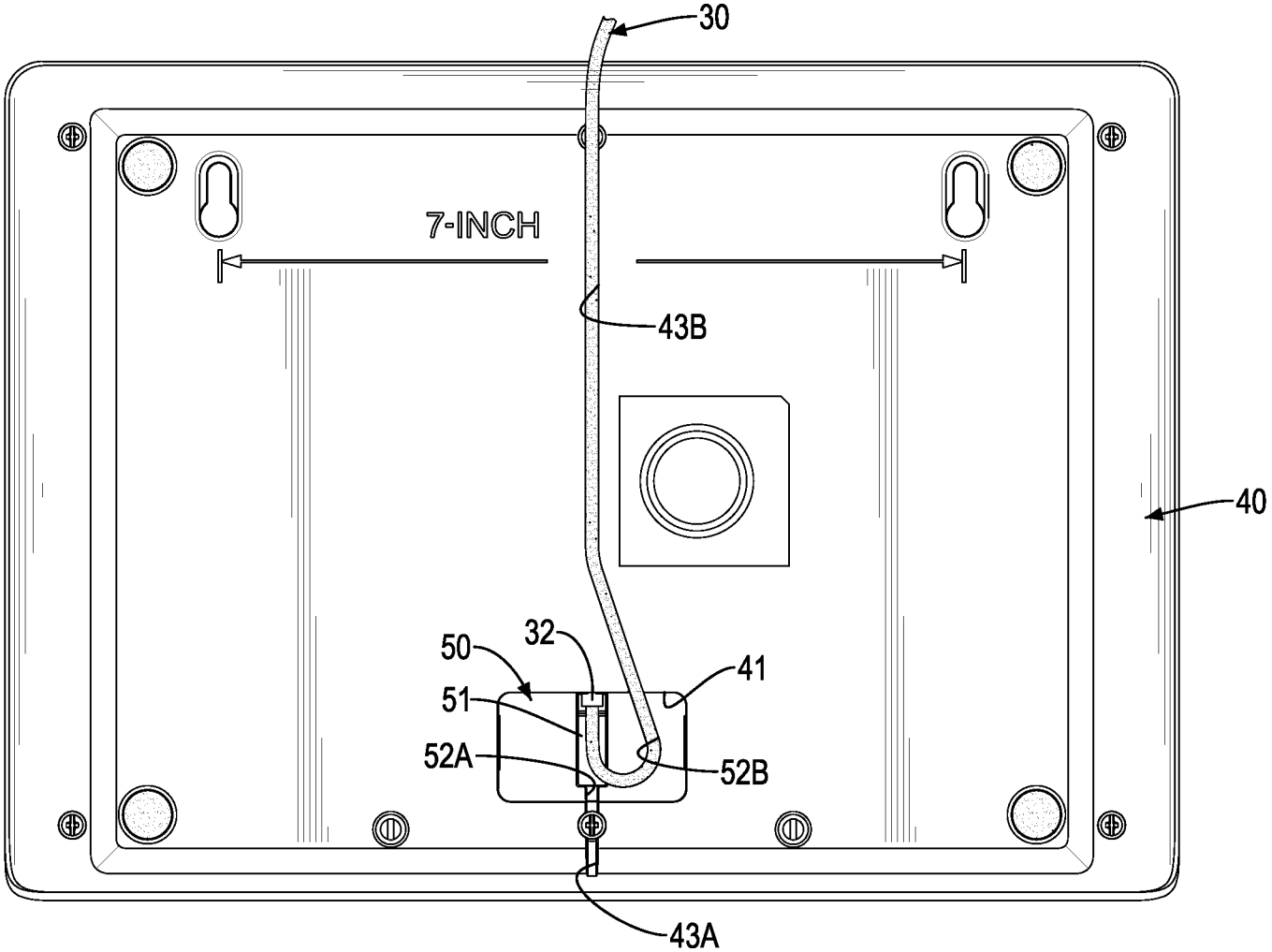
FIG. 7 is an operational rear view of the indoor antenna in FIG. 1.
Figure 8:
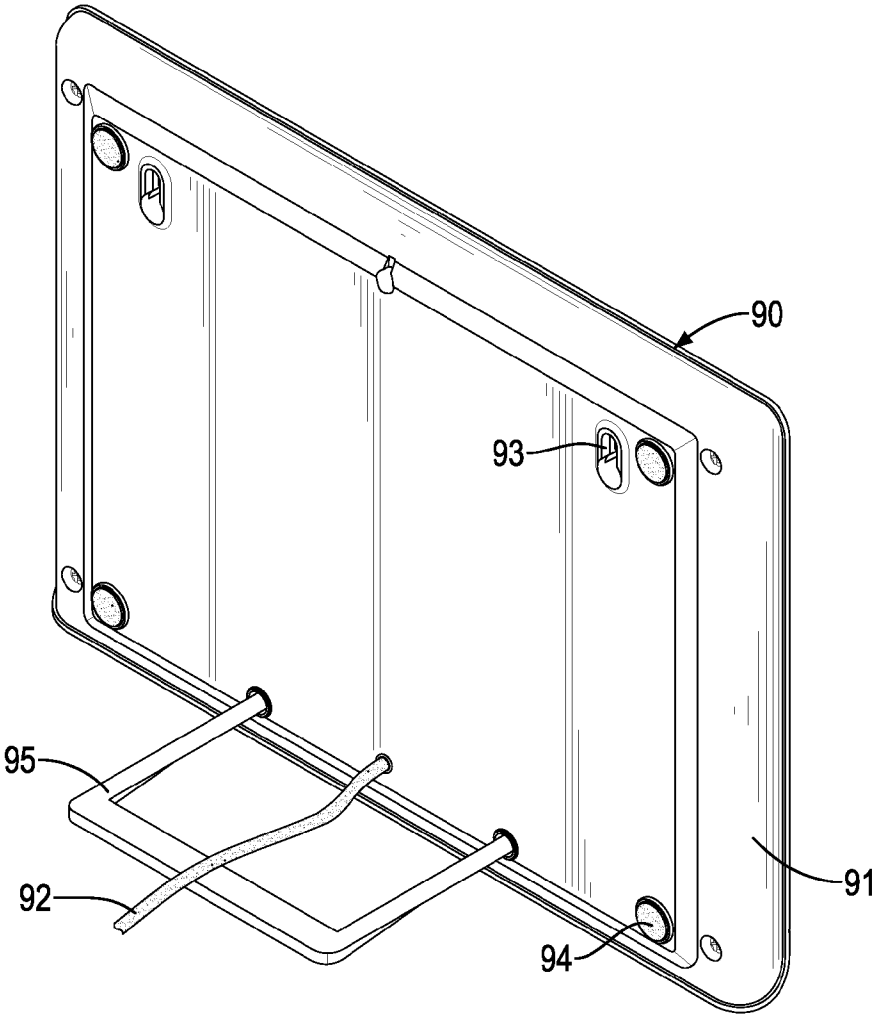
FIG.8 PRIOR ART
FIG. 8 is a perspective view of a conventional indoor antenna.

With reference to FIGS. 1, 6 and 7, in use, the coax cable 30 can be selectively mounted in a desired one of the first coax cable channels 43A, 43B and a corresponding one of the second coax cable channels 52A, 52B. With reference to FIG. 6, the coax cable 30 is mounted in the first coax cable channel 43A and the second coax cable channel 52A, such that the coax cable 30 can extend smoothly from a bottom of the indoor antenna. With reference to FIG. 7, the coax cable 30 is mounted in the first coax cable channel 43B and the second coax cable channel 52B, such that the coax cable 30 can extend smoothly from a top of the indoor antenna.

With reference to FIGS. 2 to 4, the cover through hole 41 can be inserted through by the coax cable 30, such that the coax cable 30 can be further mounted in the coax cable recess 51 and the coax cable channels 43A, 43B, 52A, 52B. The engagement recesses 321 are clamped by the coax cable slits 421, and the hole cover 50 can be mounted in the cover through hole 41, such that an assembling method of the indoor antenna can be modularized effectively.

From the above description, it is noted that the present invention has the following advantages:

1. The panel cover 40 has multiple first coax cable channels 43A, 43B that can accommodate the coax cable 30, such that the indoor antenna maintains good performance and can be assembled in different ways without interfering with or distending the coax cable 30, to thereby improve the digital signal transmission of the coax cable 30.

2. When the coax cable 30 is securely arranged in one of the first coax cable channels 43A, 43B, the indoor antenna can accurately abut the wall or the ground, such that the indoor antenna can have an aesthetic appeal.

3. The panel cover 40 can further have more first coax cable channels that have different extension directions for different assembling demands.

4. The cover through hole 41 can be inserted through by the coax cable 30 and sheltered by the hole cover 50, such that the hole cover 50 can further fix a position of the coax cable 30. Therefore, the assembling of the indoor antenna can be modularized easily, and the assembly efficiency of the indoor antenna can be improved.

5. The coax cable 30 is fixed by the positioning sleeve 32 and the coax cable slit 421, such that the coax cable 30 can be fixed easily. Furthermore, the coax cable 30 can be kept from being pulled by the user, such that a lifetime of the coax cable 30 can be prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An indoor antenna having:

a cover body having a panel cover, wherein the panel cover has an edge;

at least one first coax cable channel formed in a side of the panel cover and formed through the edge of the panel cover; and a cover through hole formed through the panel cover;

a coax cable panel mounted in the cover body, and inserted through the panel cover via the cover through hole; and a coax cable electrically connected with the coax cable panel, inserted through the panel cover, mounted in one of the at least one first coax cable channel, and extending out of the edge of the panel cover;

a hole cover mounted in the cover through hole and having a coax cable recess formed in a side of the hole cover, accommodating the coax cable and communicating with the at least one first coax cable channel.

2. The indoor antenna as claimed in claim 1, wherein the panel cover has two first coax cable channels formed in the side of the panel cover and respectively formed through a top and a bottom of the edge of the panel cover.

3. The indoor antenna as claimed in claim 2, wherein the panel cover further has a cover through hole formed through the panel cover, wherein the coax cable is inserted through the panel cover via the cover through hole; and a hole cover is mounted in the cover through hole and has a coax cable recess formed in a side of the hole cover, accommodating the coax cable and communicating with the at least one first coax cable channel.

4. The indoor antenna as claimed in claim 3, wherein the panel cover further has a hole wall formed on the side of the panel cover and annularly around the cover through hole, wherein the hole wall has a coax cable slit formed in the hole wall and accommodating the coax cable.

5. The indoor antenna as claimed in claim 4, wherein a positioning sleeve is mounted around the coax cable and clamped by the coax cable slit, wherein an outer diameter of the positioning sleeve is larger than an outer diameter of the coax cable.

6. The indoor antenna as claimed in claim 5, wherein the positioning sleeve further has two engagement recesses respectively formed in two sides of the positioning sleeve and clamped by the coax cable slit.

7. The indoor antenna as claimed in claim 6, wherein the cover through hole and the hole cover are rectangular.

8. The indoor antenna as claimed in claim 1, wherein the panel cover further has a hole wall formed on the side of the panel cover and annularly around the cover through hole, wherein the hole wall has a coax cable slit formed in the hole wall and accommodating the coax cable.

9. The indoor antenna as claimed in claim 8, wherein a positioning sleeve is mounted around the coax cable and clamped by the coax cable slit, wherein an outer diameter of the positioning sleeve is larger than an outer diameter of the coax cable.

10. The indoor antenna as claimed in claim 9, wherein the positioning sleeve further has two engagement recesses respectively formed in two sides of the positioning sleeve and clamped by the coax cable slit.

11. The indoor antenna as claimed in claim 10, wherein the cover through hole and the hole cover are rectangular.

* * * * *